US006595507B2

(12) United States Patent
Dykstra

(10) Patent No.: US 6,595,507 B2
(45) Date of Patent: Jul. 22, 2003

(54) HOLD DOWN TOGGLE CLAMP

(75) Inventor: Henry Dykstra, Hartland, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/934,861

(22) Filed: Aug. 22, 2001

(65) Prior Publication Data

US 2003/0038417 A1 Feb. 27, 2003

(51) Int. Cl.[7] ..... B25B 1/14
(52) U.S. Cl. ..... 269/228; 269/94; 269/32
(58) Field of Search ..... 269/228, 32, 282, 269/237, 238, 201

(56) References Cited

U.S. PATENT DOCUMENTS 2,456,100 A * 6/1945 Wood ..... 144/290
3,924,844 A * 12/1975 Bachtel ..... 269/94
4,011,649 A 3/1977 Hawkins
4,141,543 A 2/1979 Kato
5,165,148 A * 11/1992 Fleischer ..... 24/494
5,921,535 A * 7/1999 Lutz, III ..... 269/228
5,961,109 A * 10/1999 Dykstra ..... 269/228

* cited by examiner

*Primary Examiner*—Joseph J. Hail, III
*Assistant Examiner*—Daniel Shanley
(74) *Attorney, Agent, or Firm*—Dinnin & Dunn, P.C.

(57) ABSTRACT

A hold down clamp that includes a base member. The hold down clamp further includes a bar pivotally connected to the base member on one end thereof. A handle is pivotally connected to a base member and on an end opposite of the bar. The clamp further includes a link connected to the handle and the bar. The link has a stopper extending from a side thereof. The clamp also includes a holder member connected to an end of the bar.

15 Claims, 2 Drawing Sheets

HOLD DOWN TOGGLE CLAMP

BACKGROUND OF THE INVENTION

1. Field of the Invention

The present invention relates to clamps generally, and more particularly relates to a manual hold down clamp.

2. Description of Related Art

Toggle and hold down clamps have been used and known in the art for many years. A typical hold down or toggle clamp includes a clamping arm which pivots between a released and clamped position. The clamps are used to hold work pieces in place for processing, for clamping two objects to one another, or for clamping an object to a work table or other surface. Toggle and hold down clamps generally are quickly engageable and disengageable to the work piece or object being held. They also provide a considerable holding and clamping force which enables them to hold the work piece or object securely where needed.

The prior art toggle clamps can be exemplified in prior U.S. Pat. Nos. 5,921,535, 4,141,543 and 4,011,649. Other prior art clamps are exemplified by De-Sta-Co Industries in Madison Heights, Mich., Model Series 207. Many of these prior art devices hold the clamp position through a variety of means, these means include maintaining the force applied to the bar or arm of the clamp. Other prior art clamps use a releaseable latch assembly for the toggle clamp. Further, prior art clamps create a holding force by passing the links of the toggle clamps to an over center position, the over center position subjects the links and the pivot points of the clamp to very high loads resulting in increase wear and potential deformation of the clamp components thereby reducing the life of the clamp. There also have been problems with prior art clamps releasing due to vibration and other unforeseen forces during the use of the clamps. Many of the prior art clamps also included several bends in the links and power arms of the clamp, thus reducing performance strength by amounts up to 30 to 40%. Furthermore, clamps that include parts that have bends are not interchangeable and have to be put together in a certain manner, thus increasing the cost of labor of assembling the clamps. This also increases the number of parts needed to build a specific number of the prior art clamps.

Therefore, there is a need in the art for a new toggle hold down action clamp that is more robust, has greater strength and interchangeability than the prior art clamps.

SUMMARY OF THE INVENTION

One object of the present invention is to provide an improved hold down clamp.

Another object of the present invention is to provide a more robust hold down clamp.

Still another object of the present invention is to provide a hold down clamp with fewer bends in the clamp parts which strengthens the individual parts and reduces their cost.

Still a further object of the present invention is to provide a clamp that has better interchangeability, which will improve assembly and manufacturing of the clamps.

Still another object of the present invention is to provide a clamp that reduces the number of different parts stamped in order to build a specific number of hold down clamps.

Still a further object of the present invention is to provide a clamp wherein the spindle clears the hold down part by only rotating a predetermined distance.

It is still a further object of the present invention to provide a clamp that eliminates the need for any high cost and complex parts to create an over center stop and to create a clamp that has no pinch points for an operator.

To achieve the foregoing objects the hold down clamp according to the present invention includes a base member. The clamp also includes a bar pivotally connected to the base member on one end thereof. The handle is pivotally connected to the base member on an end opposite of the bar. The clamp further includes a link connected to the handle and the bar such that the link has a stopper extending from a side thereof. The hold down clamp also includes a holding member connected to an end of the bar.

One advantage of the present invention is that the hold down clamp is more robust and removes any bends and replaces them with straight parts in the clamp.

Another advantage of the present invention is that the hold down clamp has increased strength.

Yet a further advantage of the present invention is that the clamp provides for interchangeability of all parts except the handle.

Another advantage of the present invention is that the number of different parts needed to be stamped to build a certain number of clamps is greatly reduced due to the interchangeability of the parts.

Another advantage of the present invention is that the clamp has a spindle that clears the part being held with a predetermined rotation of the arm.

Still a further advantage of the present invention is that the clamp eliminates pinch points by placing moving parts of the clamp within the handle mechanism.

Other objects, features, and advantages of the present invention will become apparent from the subsequent description, and the appended claims, taken in conjunction with the accompanying drawings.

DESCRIPTION OF THE PREFERRED EMBODIMENT(S)

The invention will now be described with reference to the drawings, where in like numerals in different drawing figures indicate like elements.

Figure 1:
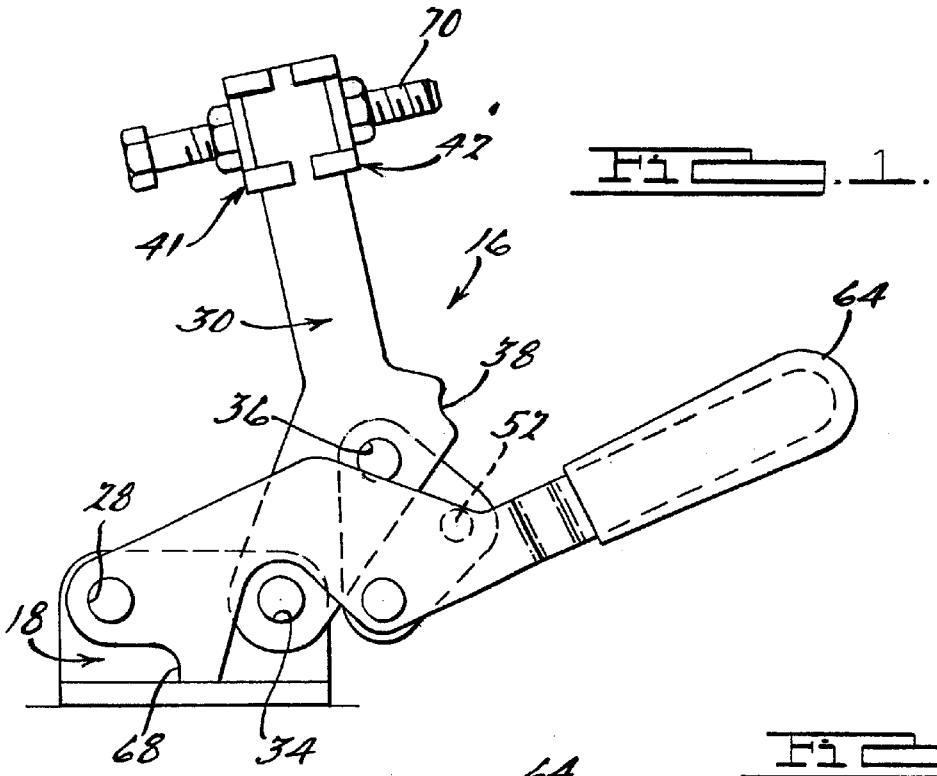
FIG. 1 shows a side view of the present invention.
Figure 2:
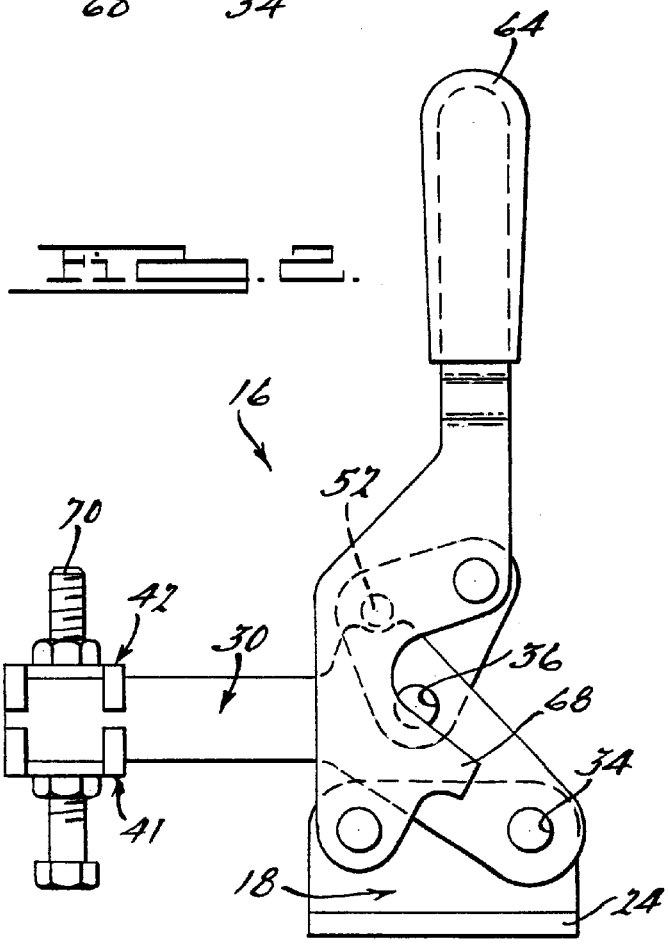
FIG. 2 shows the present invention in its closed or locked position.
Figure 3:
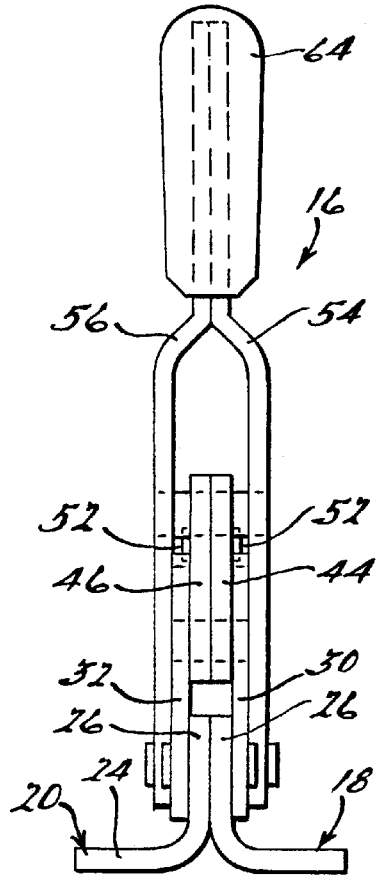
FIG. 3 shows an end view of the present invention.

FIGS. 1,2 and 3 show a full embodiment of the hold down clamp 16 according to the present invention. The clamp 16 includes a first and second base member 18, 20 with each base member 18, 20 generally having an L-shaped cross section. The base members 18, 20 include a plurality of orifices 22 through a bottom surface thereof and a side surface thereof. The bottom flange 24 of the base member 18, 20 generally has two orifices 22 therein and those orifices 22 are used to secure, via a fastener, the clamp 16 to a bench, tool or other work device. The upright portion 26 of the base member 18, 20 includes a first and second orifice 28 that are used to connect to other parts of the clamp. The base members 18, 20 are placed such that the upright portion 26 of the base members are in contact with one another and the bottom flanges 24 of the base members 18, 20 extend away from each other as shown. It should be noted that in the preferred embodiment all of the working parts of the clamp 16 are made out of a metal material preferably a steel. However, it should be noted that any other type of hard metal or hard ceramics or plastics may also be used in the design of the clamps.

Figure 8:
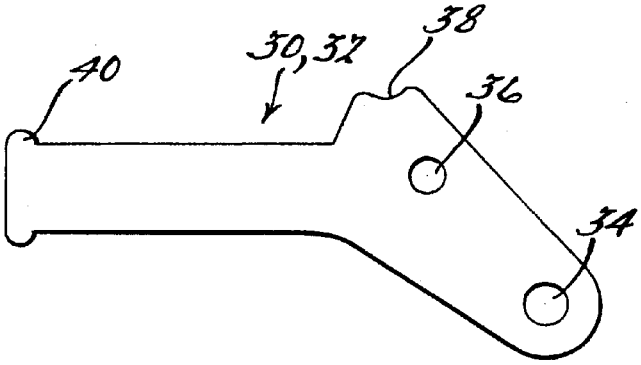
FIG. 8 shows a side view of a bar member according to the present invention.

Contacting an outside surface of the first and second upright portion 26 of the base member 18, 26 are a first and second power arm or bar member 30, 32. The power arm or bar member 30, 32 is flat and straight along its edge, such that no bends or offsets occur on the bar 30. The bar member 30 includes a first 34 and second orifice 36 and also includes a notch 38 along one surface thereof. On one end of the bar member 30, 32 is a knob 40 which is used to secure a holder member 42 on the clamp 16. The first and second bar members 30, 32 are pivotally connected to the upright portion 26 of the base members 18, 20 on opposite sides of the base members 18, 20, such that the first and second base members 18, 20 are disposed between the first 30 and second bar members 32. The bar members 30, 32 are connected, via a rivet to the first and second base member 18, 20 at the first orifice 34 of the bar member 30, 32. The bar member 30, 32 is shown in side view in FIG. 8. The bar member 30, 32 is situated and connected to the base member 18, 20 such that the notch 38 faces in a direction opposite of the base member 18, 20 when the clamp 16 is in a second position or closed position.

Figure 4:
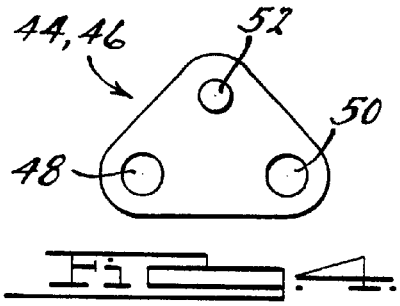
FIG. 4 shows a side view of a link member of the present invention.
Figure 5:
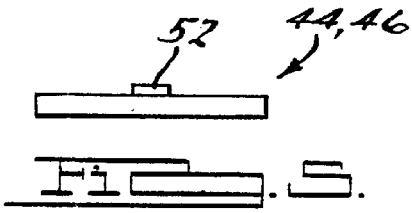
FIG. 5 shows an end view of a link member according to the present invention.
Figure 7:
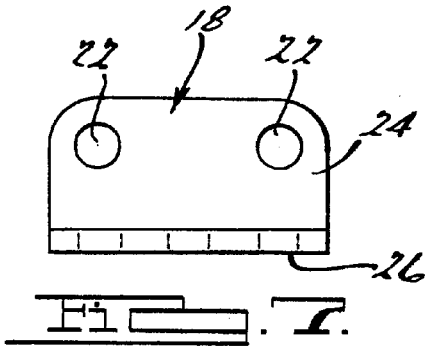
FIG. 7 shows a top view of a base member according to the present invention.
Figure 6:
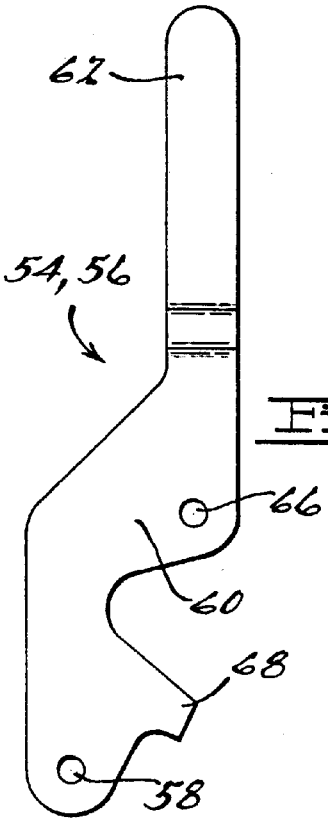
FIG. 6 shows a side view of a handle according to the present invention.

Link members 44, 46 as shown in FIGS. 4 and 5 generally have a triangular shape. The link members 44, 46 include a first 48 and second orifice 50 and a stopper or button 52 extending from a side surface thereof. The first 44 and second link member 46 are pivotally connected to the bar members 30, 32 at the second orifice 36 of the bar member and the first orifice 48 of the link member via a pin. The pin includes a shoulder surface that engages with the bar members 30, 32. The first and second link member 44, 46 are secured back to back such that the buttons 52 extend from each side of the link member 44, 46 and are able to interact with the notch 38 found on a top surface of the bar members 30, 32. An outer surface of the first and second link member 44, 46 is adjacent to an inner surface of the first and second bar member 30, 32 respectfully. Therefore, the first and second link members 44, 46 are disposed between the first and second bar members 30, 32 in the clamp 16. It should be noted that the button 52 is pressed out of the side of the link member 44, 46 via a punching operation and therefore, a weld is not needed to create an over center stop for the hold down clamp 16.

As shown in FIGS. 1–3 and FIG. 6 the clamp 16 includes a first 54 and second handle member 56. The first and second handle members 54, 56 are pivotally connected to the base members 18, 20 via a first orifice 58 in the handle 54, 56. The handle member 54, 56 generally has a body portion 60 and an arm 62 extending from the body portion 60. Where the body portion 60 and the arm 62 intersect there is an offset or bend in the handle member 54, 56. The handle member 54, 56 is the only part of the clamp 16 that includes an offset or bend, in a moving part of the clamp mechanism. The link members 44, 46 and the bar members 30, 32 are straight and therefore increase the strength of the clamp, on the order of 30 to 40%, over prior art clamps. The handle member 54, 56 includes the offset such that all moving parts of the clamp 16 are located within the first and second handle members 54, 56 and therefore prevent any pinch points from interacting with a user of the clamp 16. The handle members 54, 56 are pivotally connected to the base members 18, 20 such that the arms 62 of the first and second handle member 54, 56 are in contact with each other and have a grip 64, made out of a plastic, rubber or like material, fixed over the ends of the two handle members 54, 56. The handle member 54, 56 is also pivotally connected via its second orifice 58 to the second orifice 50 of the link member 44, 46. The connection is made via a fastener, preferably a rivet that includes a bushing surrounding the rivet. The pivot connection of the handle member 54, 56 to the base member 18, 20 is secured by a fastener, in the preferred embodiment that fastener is a rivet and a bushing.

The first and second handle members 54, 56 also include a leg member 68 which extends from a surface of the body 60. The leg member 68 contacts the flanges 24 of the first and second base member 18, 20 when the clamp 16 is in a first or open position. When the leg member 68 is in contact with the base member 18, 20 the arm 62 of the handle has a predetermined angle from the base member 18, 20. This angle provides for increased clearance for the hands and fingers of the operator of the clamp 16. In the preferred embodiment the angle is approximately 30°, however it should be noted that any angle from 10° to 60° may be designed into the clamp 16. The handle member 54, 56 is positioned such that an inside surface of the first and second handle members 54, 56 are adjacent to an outside surface of the first and second bar members 30, 32. The handle members 54, 56 are arranged such that the first and second bar members 30, 32 and the first and second base members 18, 20 along with the first and second link members 44, 46 are all disposed between the first and second handle members 54, 56 within a space provided by the offset of the first and second handle members 54, 56. It should be noted that the first and second handle members 54, 56 are the only members of the clamp 16 that have a specific left hand and right hand part. All other parts of the clamp 16, including the base members 18, 20, are interchangeable parts and therefore reduce the number of different parts that have to be stamped in assembling a predefined number of clamps.

Figure 9:
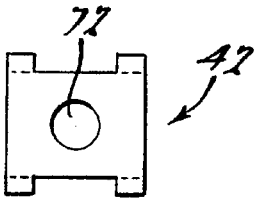
FIG. 9 shows a top view of a holding member.
Figure 10:
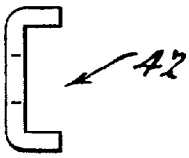
FIG. 10 shows a side view of a holding member according to the present invention.

Located on an end of the first and second bar members 30, 32 are first and second holder members 41, 42 which are generally shown in FIGS. 9 and 10. The holder member 41, 42 has an orifice 72 through a center portion thereof and generally has a U-shaped cross section. The first and second holder member 41, 42 are placed such that they extend across the first and second bar members 30, 32 and create an increase of strength at the point for the spindle 70 to operate from. The holder members 41, 42 also further strengthen the clamp 16 by securing the first and second bar member 30, 32 to one another thus, reducing any torquing of the bars or bending forces found between the bar members if left unattached. The preferred embodiment uses a bolt as the spindle 70 but any other type of straight member may be used as the spindle depending on the needs and design of the part being held down by the hold down clamp.

In operation the clamp 16 is in an open position when the handle member 54, 56 is pulled fully open and the leg 68 rests on the flange of the base member 18, 20 as shown in FIG. 1. The handle member 54, 56 is designed such that the arm 62 of the handle member has a predetermined angle from the base member 18, 20 such that there is an increase in clearance for the hands and fingers of the operator. It should further be noted that an increase of clearance occurs between the arm 62 of the handle and the bar member 30, 32 which extends in an upright position when the clamp 16 is in the fully open position. This provides for increased clearance, such that the knuckles and fingers of the operator are not engaged with the bar member 30, 32 when operating the clamp 16. In the open position the spindle 70 of the clamp 16, which is connected via the holder member 42 to the end of the power arm or bar members 30, 32 clears the part being secured by the clamp by approximately 70°. The prior art clamps usually would clear the part by approximately 95° or greater. This would cause problems in removing the part from the clamp in prior art clamps. It should be noted that a clearance of anywhere between 90° and 60° is capable with the clamp of the present invention.

When the operator wants to secure the part being clamped, the operator will move the handle member 54, 56 into a vertical position from its closed or first open position into a second or closed position such that the handle 54, 56 is placed into a nearly upright position. The clamp 16 secures the work piece by having an over center position between the power arm 30, 32 and the link member 44, 46 and handle members 54, 56 such that an over center force is created. This over center force amplifies the force and holding power of the clamp 16. The over center point is engaged when the buttons or stoppers 52 engage with the notch 38 of the bar members to create the over center or highest force position for the clamp 16. FIG. 2 shows a clamp 16 in the closed position with the button 52 engaging the notch 38 of the bar member, thus putting the clamp into the over center position or closed position. The force is created by the link members 44, 46 rotating with respect to the handle member 54, 56 and bar member 30, 32. The notch 38 and over center buttons 52 merely define the over center position which creates the greatest force capable by the toggle link of the clamp 16.

It should be noted that the use of an over center button that is punched or formed into the metal is preferred over the prior art use of welding a pin or other device as an over center stop and clamps. This provides for a more reliable over center point thus increasing the strength and durability of the clamp 16. With regards to the interchangeability of all clamp members, excluding the first and second handle members 54, 56 the use of the members with straight or linear parts also increases the strengths. Anywhere a bend or offset is located in prior art clamps creates stresses and weakens the clamp thus reducing the overall life of the clamp. The clamp according to the present invention uses all straight or linear parts. The use of the straight or linear members for the link and bar members increases the strength by approximately 30 to 40% over prior art clamps thus increasing the life and serviceability of the clamps in the field.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A hold down clamp, said clamp including:
   - a base member generally having an L-shaped cross-section and a plurality of orifices;
   - a bar pivotally connected to said base member on one end thereof, said bar having a notch on a surface thereof;
   - a handle pivotally connected to said base member on one end opposite of said bar, said handle having a first and second orifice, said handle having an offset bend therein;
   - a link connected to said handle and said bar, said link having a stopper extending from a side thereof, and
   - a holder member connected to one end of said bar.

2. The clamp of claim 1 wherein said link having a first and second orifice.

3. The clamp of claim 1 wherein said handle having a leg extending therefrom, said leg contacting said base when the clamp is in an open position.

4. The clamp of claim 1 wherein said bar has a first and second orifice.

5. The clamp of claim 4 wherein said bar and said link are straight.

6. The clamp of claim 4 wherein said first orifice of said link is pivotally connected to said second orifice of said bar via a fastener.

7. The clamp of claim 4 wherein said second orifice of said link is pivotally connected to said second orifice of said handle via a fastener.

8. The clamp of claim 4 wherein said stopper engages with said notch when the clamp is over center and in a closed position.

9. The clamp of claim 3 wherein said handle having a predetermined angle from said base for increased clearance when the clamp is in a closed position.

10. A hold down clamp, said clamp including:
   - a base having a plurality of orifices therein;
   - a first and second bar member, said bar member pivotally connected to said base on opposite sides thereof via a fastener, said bar members having a notch therein;
   - a first and second link member, said link members pivotally connected to said bar members on an inside surface of said first and second bar member such that said link members are disposed between said bar members, said link members having a stopper extending from a surface thereof;

a first and second handle member pivotally connected to said base via a fastener and pivotally connected to said first and second link members via a fastener, said handle members having an offset therein, said handle members adjacent to said bar members such that said bar members are disposed between said first and second handle members; and a holder member engaging said bar members.

11. The clamp of claim 10 wherein said handle members having a leg extending therefrom, said leg contacting said base when the clamp is in a first position.

12. The clamp of claim 10 wherein said stopper contacts said notch when the clamp is in a second position.

13. The clamp of claim 11 wherein said handle members having a predetermined angle from said base when in said first position.

14. The clamp of claim 12 wherein the clamp is at over center when the clamp is in said second position.

15. The clamp of claim 10 wherein said first and second bar members and said first and second link members are straight, such that said bar members are interchangeable within the clamp and said link members are interchangeable within the clamp.

* * * * *